US005134537A

United States Patent [19]

Buss et al.

[11] Patent Number: 5,134,537

[45] Date of Patent: Jul. 28, 1992

[54] NEGATIVE VOLTAGE CLAMP CIRCUIT FOR CONTROLLING CURRENTS IN INDUCTIVE LOADS

[75] Inventors: Kenneth G. Buss; Eric E. Campos, both of Dallas, Tex.

[73] Assignee: Texas Instruments Incorporated, Dallas, Tex.

[21] Appl. No.: 803,756

[22] Filed: Dec. 5, 1991

Related U.S. Application Data

[63] Continuation of Ser. No. 480,484, Feb. 16, 1990, abandoned.

[51] Int. Cl.[5] ..... G05F 1/563; G05F 1/59

[52] U.S. Cl. ..... 361/154; 361/159; 361/205; 318/434; 323/268; 323/287

[58] Field of Search ..... 323/282-289, 323/268; 318/436, 434, 474, 476, 478

[56] References Cited

U.S. PATENT DOCUMENTS

| | | | |
|---|---|---|---|
| 4,446,410 | 5/1984 | Yagura et al. | 318/687 |
| 4,605,983 | 8/1986 | Harvey | 361/154 |
| 4,680,667 | 7/1987 | Petrie | 361/154 |
| 4,949,215 | 8/1990 | Studtmann et al. | 361/154 |
| 4,967,309 | 10/1990 | Hoffman | 361/160 |
| 4,980,793 | 12/1990 | Glowczewski et al. | 361/154 |

*Primary Examiner*—A. D. Pellinen
*Assistant Examiner*—David Osborn
*Attorney, Agent, or Firm*—B. Peter Barndt; Richard L. Donaldson

[57] ABSTRACT

A circuit capable of driving inductive loads below a chip substrate voltage level while minimizing on-chip power dissipation and eliminating parasitic effects. Two negative voltage drive modes are included in the circuit design. The first drive circuit forces a low negative voltage referenced to the circuit output voltage across an inductive load referenced to ground to provide a slow recirculation of the current in the inductive load. The second drive circuit forces a large negative voltage referenced to the circuit output voltage across the inductive load to provide a fast collapse of the inductive load. The switching regulator switches off when the current to the inductive load reaches a first value and switches on when the recirculating current from back e.m.f. reaches a second value. The switching regulator initially provides a higher level of power when first tuned on.

16 Claims, 4 Drawing Sheets

NEGATIVE VOLTAGE CLAMP CIRCUIT FOR CONTROLLING CURRENTS IN INDUCTIVE LOADS

This application is a continuation of application Ser. No. 07/480,484, filed Feb. 16, 1990, abandoned.

BACKGROUND OF THE INVENTION

1. FIELD OF THE INVENTION

This invention relates to a drive circuit for an inductive load and, more specifically, to a negative voltage clamp circuit for controlling currents in inductive loads, particularly solenoids.

2. BRIEF DESCRIPTION OF THE PRIOR ART

Solenoids are useful in many areas, such as, for example, in conjunction with automobile transmissions and the like. It is desirable to provide a solenoid, preferably but not solely for use in such transmissions, which are capable of rapid operation. In this regard, it is necessary to provide a drive circuit for the solenoid which initially furnishes high drive current for fast solenoid pull-in or turn on and then furnishes lower drive current for hold-in of the solenoid for continuous solenoid operation thereafter. The lower hold-in current is desirable because the high current required for fast pull-in is no longer necessary and results in a decrease of power dissipation. Also, when operating at the lower current, and for example, changing to a different solenoid drive in the transmission, the solenoid can be completely disabled or drop out more rapidly as compared with operation at the higher pull-in current due to the storage of less energy in the coil of the solenoid. Accordingly, it is desirable that the solenoid have fast pull-in lower current and hold-in and fast drop out.

It is also desirable that the circuit include diagnostics and fail-safe types of information and control either during or prior to commencement of solenoid drive circuit operation to avoid operation which could damage the solenoid and/or associated circuitry.

Applicants herein are unaware of any prior art that performs the above desired functions or of any prior art that permits the control of relatively large recirculating current (about 6 amperes) below a junction isolated substrate potential (p-type substrate) with negative voltages in excess of −2 volts. Applicants are aware of high-side drivers which can provide large negative going transients (below substrate voltage) for the fast collapse of inductive loads. However, a higher on-chip power dissipation occurs when using that approach.

SUMMARY OF THE INVENTION

In accordance with the present invention, the above noted problems of the prior art are minimized and there is provided a driver circuit capable of solenoid pull-in, hold-in and rapid drop out. The driver circuit is set forth in the preferred embodiment as a part of the output driver stage for a 6 ampere automotive solenoid transmission driver with on-chip intelligence and diagnostics to detect open loads, hard and soft short circuits, over-voltage and over-temperature conditions. In addition, the overall circuit sets a pull-in time with an inverse voltage coefficient (i.e., the pull-in time increases with a decreasing power supply voltage and decreases with an increasing power supply voltage). It should be understood that the driver circuit and/or solenoid disclosed herein can be used in environments other than with automotive transmissions.

In accordance with the invention, there is provided a circuit capable of driving inductive loads below the chip substrate voltage while minimizing on-chip power dissipation and eliminating parasitic effects. Two negative voltage drive modes are included in the circuit design. The first drive circuit forces a low negative voltage referenced to the circuit output voltage across an inductive load referenced to ground to provide a slow recirculation of the current in the inductive load. The second drive circuit forces a large negative voltage referenced to the circuit output voltage across the inductive load to provide a fast collapse of the inductive load.

DESCRIPTION OF THE PREFERRED EMBODIMENT

Figure 1:
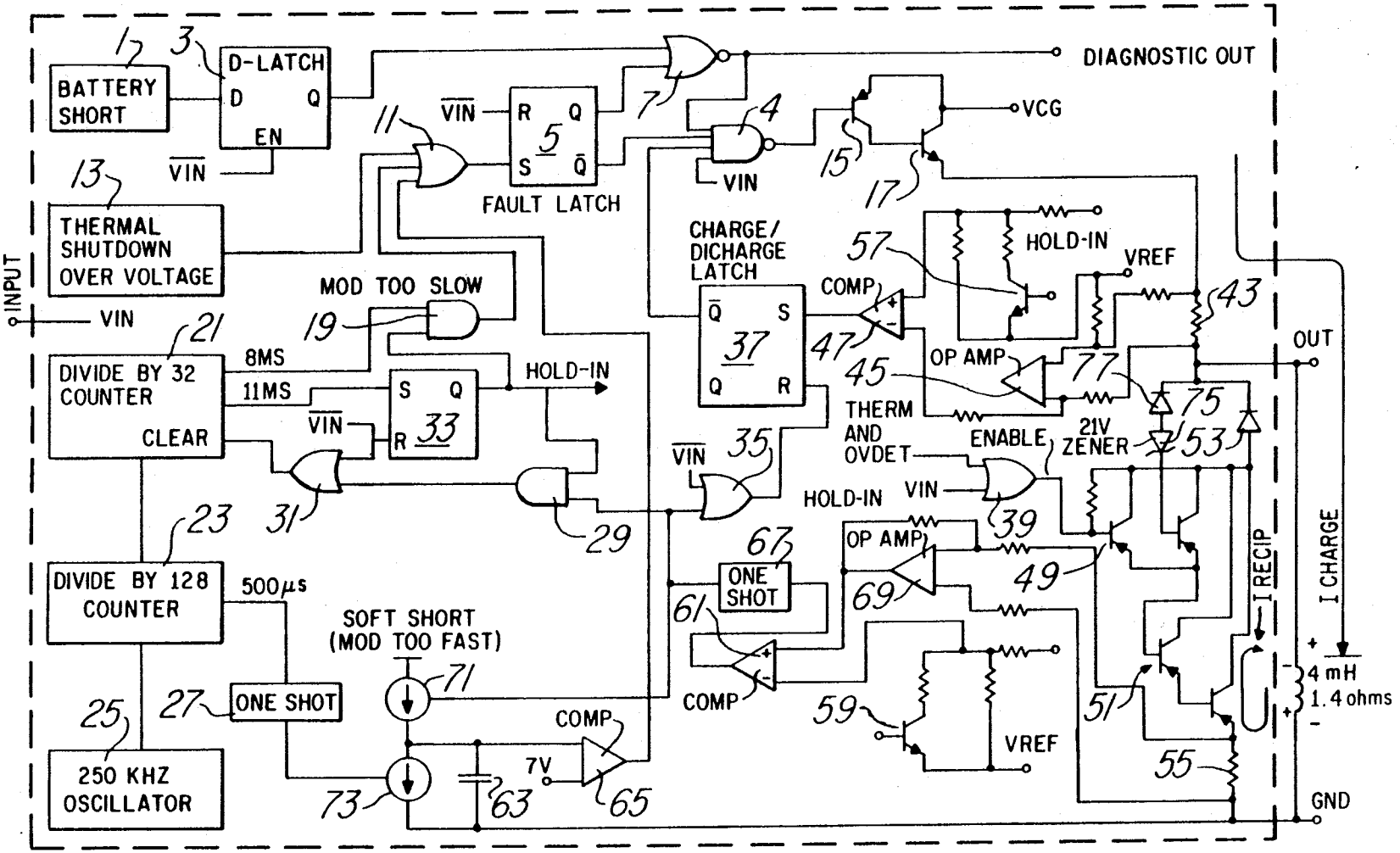
FIG. 1 is a block diagram of a solenoid driver circuit in accordance with the present invention.

Referring first to FIG. 1, there is shown the complete circuit block diagram for a solenoid driver in accordance with the present invention. The driver includes input and output (OUT) terminals, a pair of power terminals (Vcc and GND) and a diagnostic output terminal.

The complement signal Vin at the input terminal on its complement Vin bar provides an enable signal to the D-latch 3, a reset signal to fault latch 5, an input to the NAND gate 9, a reset signal to flip-flop 33 and an input to OR gates 31 and the Vin input to OR gate 35 and 39, the operation of which will be explained hereinbelow.

Figure 3:
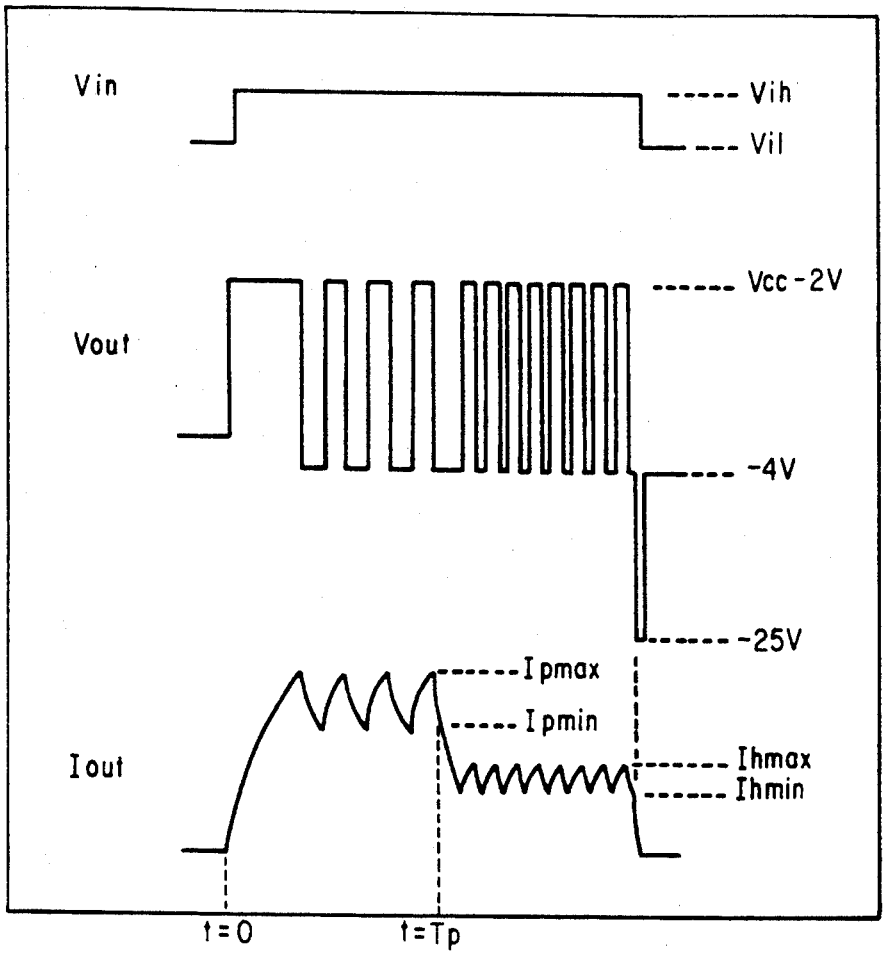
FIG. 3*a* shows a profile for the pull-in time, tp, with time (t) shown on the vertical axis in milliseconds and supply voltage (Vcc) shown in volts on the horizontal axis.
FIG. 3*b* shows three curves, the top curve showing the input signal being low prior to activation and then high during the on condition, the middle curve showing the output voltage itself and the bottom curve showing the current wave form on the output terminal.
Figure 3B:
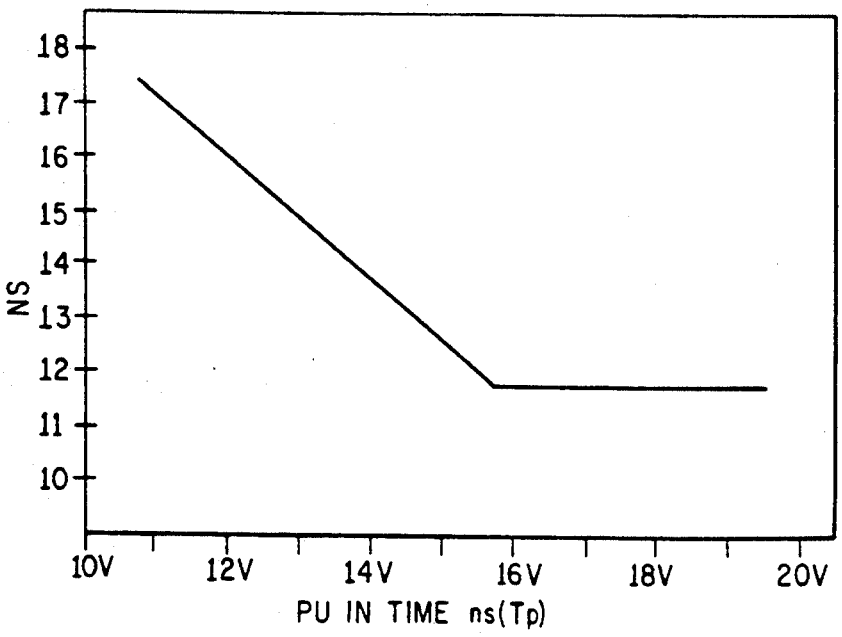

Initially, prior to receipt of a Vin signal at the input terminal (FIG. 3(*a*) top graph), it is necessary to inhibit operation of the circuit in the event a fault condition exists. This is accomplished, assuming a fault, such as, for example, a battery short circuit 1 exists, by providing a signal from the D-latch 3 prior to disenablement thereof by Vin to provide a diagnostic output flag signal through NOR gate 7 indicative of the fault condition. In addition, NAND gate 9 will have a low signal at the input thereto from the NOR gate 7 to provide a high signal to the gate of transistor 15, thereby maintaining transistors 15 and 17 off and preventing current flow to the coil 41 from Vcc.

Under normal operation when no faults are sensed and all other inputs to NAND gate 9 are high, when a Vin signal is received at the input of gate 9, the output of NAND gate 9 goes low and the transistors 15 and 17 are turned on and provide drive from voltage source Vcc to the reference voltage point designated as GND via the output coil 41 which is the solenoid coil. This current passes the output terminal and is available thereat until the current has built up to provide a predetermined IR drop (e.g. 6 amperes current) across resistor 43 at the input of OP amp 45 to provide enough gain to trip comparator 47 and set the latch 37. As can be seen, latch 37 was in the reset state until the Vin bar signal was provided to OR gate 35 at which time latch 37 was reset and capable of being set. Setting of latch 37 provides a high output from the Q bar output thereof to close the NAND gate 9 and cut off transistors 15 and 17 as well as drive current to coil 41.

At this time, since the drive current is no longer being applied to coil 41, the voltage across coil 41 changes polarity from a condition where the output terminal (out) is positive with respect to ground (GND) to a condition where the output is negative with respect to ground (FIG. 3(*a*) middle graph). Accordingly, since OR gate 39 now provides an enable signal due to the Vin signal at one of its inputs, transistor 49 is turned on and turns on the triple Darlington stack 51 to provide a current path for recirculation of the current then in the coil 41 via diode 53 and resistor 55. This oscillation of current through coil 41 continues for 10 to 20 milliseconds as shown in the bottom graph of FIG. 3(*a*) in the time period $t=t_o$ to $t=t_p$, the time being set by other circuitry via OR gate 11 which will be explained hereinbelow. This recirculating current passes through resistor 55 to set up a voltage thereacross which is amplified by amplifier 69, the output of amplifier 69 being sent to comparator 61 where it is compared with a reference voltage provided at the other input of comparator 61. When the voltage across resistor 55 has reached a predetermined minimum value as determined by the reference voltage, an output is provided which causes one shot 67 to send a signal to latch 37 via OR gate 35 and cause latch 37 to reset and shift the output of NAND gate 9, causing transistors 15 to 17 to shut.

A 250 KHz oscillator 25 provides an output which is divided by 128 in counter 23 and divided again by 32 in counter 21. The counter 21 is cleared when there is a Vin bar signal via the output of OR gate 31. The counter 21 accordingly commences counting with the removal of a Vin bar signal. The combination of an 8 millisecond signal and 11 millisecond signal from counter 21 via flip flop 33, which was reset prior to the Vin input signal, to AND gate 19 sets the fault latch 5. The 11 millisecond output sets flip-flop 33, the Q output of which is sent to the AND gate 19. The Q output from flip-flop 33 causes a change in the system from the pull-in mode to the hold-in mode after the 11 millisecond time period has elapsed via decoding of counter 21. This is accomplished by applying the hold-in signal to hold-in transistor 57 to change the reference of comparator 47 where it requires a lower IR drop (e.g. 6 amperes to 3 amperes current) across resistor 43 to provide a set signal to the latch 37. Accordingly, after the hold-in signal from the flip flop 33 Q output is provided, the above described circuitry will cause the same oscillation described above, but at a lower level as shown in the bottom curve of FIG. 3(*a*) from t=tp to the large drop off of current at the right end of the curve.

The same hold-in signal from flip-flop 33 operates a transistor 59 and changes the threshold of comparator 61 where it trips from a current corresponding to the recirculating mode during the pull-in mode to a current in the hold-in mode (e.g., about 4 amperes to about 2 amperes). The hold-in signal also permits the counter 21 to again be cleared via AND gate 29 and OR gate 31 when AND gate 29 also receives a signal during current recirculation from on shot 67.

A one shot 27 is triggered approximately every 500 microseconds (i.e., for a 250 KHz oscillator and a divide by 128 counter the exact time would be 512 microseconds) by a signal from counter 23. The one shot enables a discharge current source or current sink 73 to discharge a capacitor 63 at the input of comparator 65. The capacitor 63 is charged by current source 71 under control of one shot 67 which is tripped each time comparator 61 is tripped due to changes in recirculation current through resistor 55 via OP amp 69. Accordingly, capacitor 63 is being charged via current source 71 for the time period of on shot 67 whenever the recirculation comparator 61 is tripped and is being discharged via current source 73 for the time period of one shot 27 whenever one shot 27 is tripped (approximately every 500 microseconds). Current source 71 and current sink 73 are matched to charge up or discharge capacitor 63 at the same time rate. Accordingly, if the charge and discharge times are the same, the capacitor 63 will remain discharged. If the charge and discharge times are not the same due to change in impedance across the coil 41, then one shot 67 will trip more frequently than one shot 27 and cause capacitor 63 to charge up. Accordingly, when capacitor 63 charges enough to trip comparator 65, a signal is provided to OR gate 11 which causes the fault latch 5 to trip. The fault latch 5 disables the output drive via NOR gate 7 and NAND gate 9 and provides a diagnostic flag output as discussed above. This fault condition is the modulation to fast "soft short circuit" fault (i.e., a non-short circuit impedance across the load 41 will cause a change (increase) in the recirculating frequency which is detected by the one-shot 67).

In the case where modulation is too slow, one shot 67, which feeds counter 21 via AND gate 29 and OR gate 31 to clear counter 21 whenever a pulse is received via one shot 67, does not provide such pulse within 8 milliseconds. This causes AND gate 19 to provide a signal to OR gate 11 and set fault latch 5 with further operation continuing as noted hereinabove.

Blocking diode 77 and zener diode 75 provide an alternate path for turning on the triple PNP Darlington circuit 51. This turn on path occurs when the Vin signal is low or a thermal shutdown or overvoltage detection condition occurs at the input to OR gate 39. Diode 77 blocks the output voltage to Darlington circuit 51 when the output is positive voltage with respect to ground. When transistor 49 is disabled and the output voltage goes negative via inductive load 41 (when transistors 15 and 17 turn off), the output is clamped to −25 volts via diodes 77, 75 and Darlington circuit 51.

Figure 2:
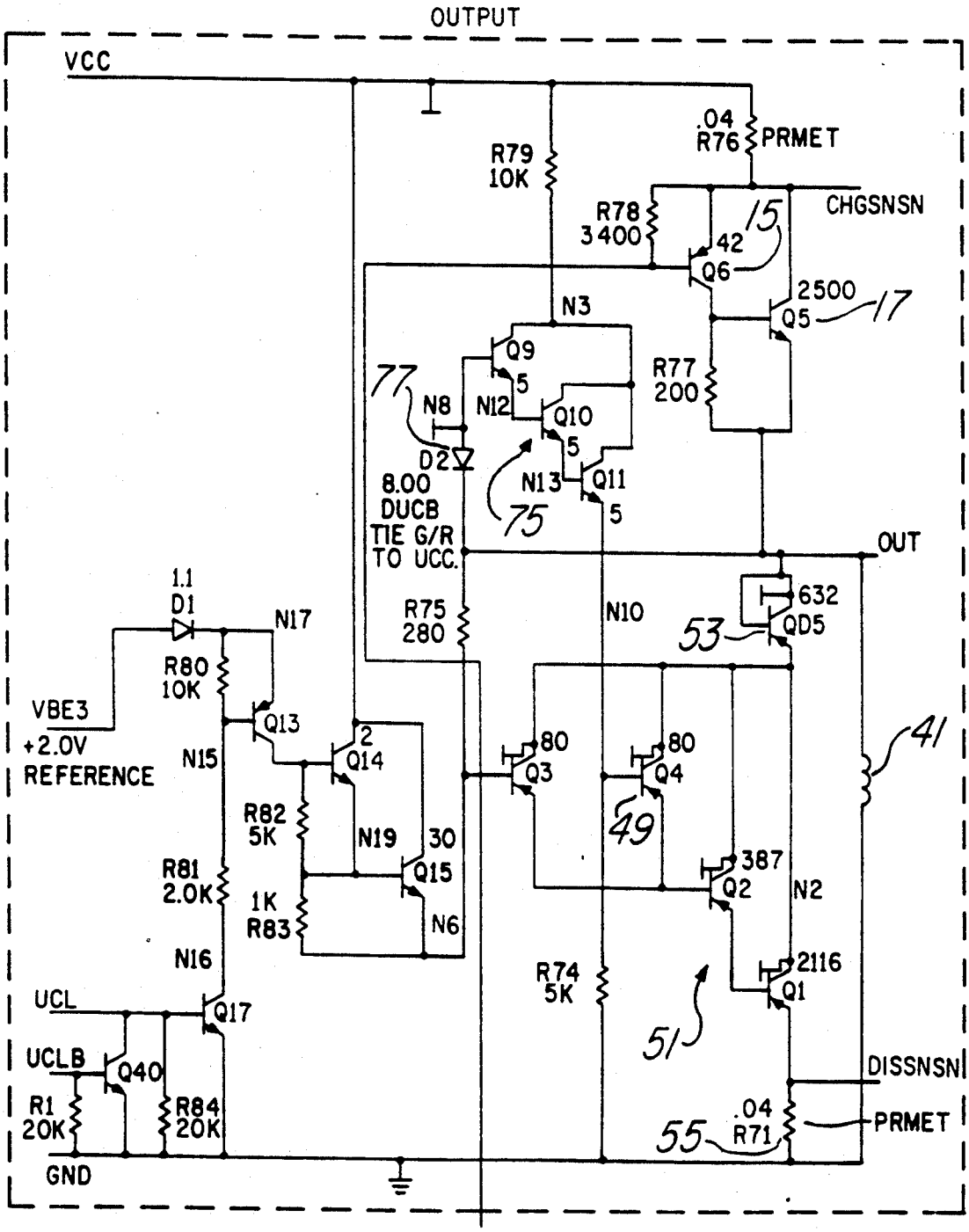
FIG. 2 is a circuit diagram of the output circuit of FIG. 1.

Referring now to FIG. 2, there is shown a circuit diagram of the output circuit of FIG. 1. Initially, drive is provided to the base of transistor 15 (Q6) which turns on transistor 17 (Q5), pulling the inductive load 41 high at the output terminal. The load current is monitored by sensing the voltage across resistor R76 until this current reaches 6 amperes. At the 6 ampere point, an R/S latch 37 of FIG. 1 is set, causing base drive to be removed from the base of transistor 15 and turning off transistor 17. When the output from transistor 17 is removed, the voltage across the inductive load 41 instantaneously swings negative, causing transistor Q1 of Darlington circuit 51 to turn on and conduct the required load current (6 amperes). An output voltage of −3 to −4 volts (Vbe of transistors Q1 and Q2 and Q3 plus Ib of transistor Q3 multiplied by the resistance of resistor 75) is required to develop current flow through resistor R75 and turn on transistors Q1, Q2 and Q3, the Darlington circuit 51. The circuitry associated with transistors Q14 and Q15 is inactive at this point, allowing transistor Q3 to turn on as it receives base drive from resistor R75. As the output current decays from the 6 ampere level, it is monitored by sensing the voltage across resistor 55 (R71) until it reaches the 4 ampere level. At the 4 ampere point, the R/S latch 37 is reset, again providing base drive to transistor 15 to turn on transistor 17. This cycle is repeated for the pull-in time Tp as shown in FIG. 3(*a*), is nominally 11 milliseconds. After the pull-in time has elapsed, the 6 ampere and 4 ampere current thresholds change to 3 ampere and 2 ampere levels respectively. The device chops at this level until the user brings the input Vin low.

When the Vin input is switched back from a high to a low state, as shown at the right of the top graph in FIG. 3(*a*), drive current is removed from the base of transistor 15 (regardless of the previous state of the output), and drive VCL from OR gate 39 (FIG. 1) is provided to the base of transistor Q17, turning on transistors Q17, Q13, Q14 and Q15 which holds the base of transistor Q3 near ground, disabling the transistor Q1, Q2, Q3, resistor R75 turn on path. In this case, the output swings more negative (ignoring the transistor Q1, Q2, Q3, resistor R75 turn on path) until the zener stack 75 (transistor Q9, Q10 and Q11) breaks down, allowing current to flow through diode 77 and the zener stack 75, providing base drive for transistors Q4 and Q2 and Q1 of Darlington circuit 51. This provides a −25 volt clamp for fast collapse of the inductive field.

The purpose of diode 53 (QD5) is to block transistors Q1, Q2, Q3 and Q4 from high positive voltages when the device output is high. Without diode 53, these transistors (Q1, Q2, Q3 and Q4) would conduct in the inverse PNP mode.

An important advantage of this design is to provide a negative voltage path for recirculation current and to lower on-chip power dissipation during the fast collapse of the inductive field. This is due to the load current being forced through the clamp voltage (−25 volts) only. This is achieved by using the isolated vertical PNP transistor which can operate with its collector, base and emitter below substrate potential (p-type substrate).

The signal on the line VBE3 is normally fixed (e.g., 2 volts) with blocking diode D1 preventing reverse bias conditions from feeding back onto the line VBE3. As long as input on line VCL, which is the same as the Vin input signal to OR gate 39 (FIG. 1), to transistor Q17 is low, transistor Q17 is off and provides no path to provide base current for transistor Q13. Therefore transistor Q13 is off and transistors Q14 and Q15 are off. Accordingly, no drive voltage is provided out of the emitter of transistor 15. This permits transistor Q3 and Darlington circuit 51 to turn on in the normal recirculating path operation as discussed in connection with FIG. 1.

When a high signal is present on input VCL, transistor Q17 is turned on and provides base drive for transistor Q13 to provide base drive for the Darlington stage composed of transistors Q14 and Q15 which can provide good current drive to their load. When the input to the circuit (Vin) is turned off, then a large negative going transient must occur on the output. This is achieved by providing sufficient drive from transistor Q15 so that the voltage drop required across resistor R75 is such that the base of transistor Q3 does not go negative enough to turn on the Darlington circuit 51 through transistor Q3. Accordingly, the voltage at the circuit output with respect to ground can go more negative and diode D2 becomes forward biased and ultimately reaches a condition where the reverse emitter-base junction of Darlington circuit 75 is in reverse breakdown condition. Then a current path is provided for the base of transistor Q4 through the reverse breakdown of Darlington circuit 75 and the forward drop of diode D2 to the output. Therefore the output negative voltage swinging level is set by the reverse breakdown of the base-emitters of Darlington circuit 75 and the forward drop of diode D2 and the forward drop of transistor Q4 and the base-emitter drop of transistor Q2 and Q1.

In prior art high-side designs, the load current was forced through the supply (typically 10 to 30 volts) in addition to the negative clamp voltage (−25 volts). This would require a larger high-side output to meet the same safe operating area goal.

An additional feature of this output section is its capability of switching between the −3 to −4 volt and the −25 volt recirculation voltage when required. This is achieved by using an isolated vertical PNP transistor (Q4) and diode D1 which is isolated in a similar manner (FIG. 4).

Referring now to FIG. 3(*a*), there are shown three curves, the top curve showing the input signal being low prior to activation and then high during the on condition and again low after activation. The middle curve shows the output voltage itself and the bottom curve shows the current wave form on the output terminal. It can be seen that when the input goes high, the output is switched to a high condition through the high side driver. This voltage remains high until the maximum current detect value is reached (Ip max) whereat the current is changed from a charging to a recirculating condition. At that time the output voltage goes negative to a level which causes Darlington circuit 51 to turn on and the output current remains at that voltage until the current recirculates to a value where the current is Ipmin. At that time, through comparator 61, the high side drive is again switched on and the output voltage of the coil changes instantaneously because current is being sourced thereto. The system cycles through these conditions until about half way through the bottom wave form at which time t=tp which is the 11 millisecond time discussed above and the circuit switches into the hold-in mode where the current peaks are lower and identified as Ihmin and Ihmax. The 11 millisecond tp switching time is independent of the Ipmax and Ipmin cycling during pull in. FIG. 3(*a*) depicts switching occurring on the negative slope of Iout. However switching could just as well have occurred on the positive slope of Iout (i.e., the setting of flip-flop 33 is independent of the Iout condition). The output voltage still swings between Vcc −2 volts and −4 volts. When the input signal Vin is again taken from the high to the low condition, the output sourcing path and the recirculating path are both disabled to enable the negative clamp condition to occur as shown by the output voltage going to about −25 volts. The output current shows a relatively rapid decay at that time due to the large negative voltage to quickly remove the energy stored in the coil 41.

Referring now to FIG. 3(*b*), there is shown a profile for the pull-in time tp. Time is shown on the vertical axis in milliseconds and supply voltage (Vcc) in volts is shown on the horizontal axis. With the higher voltages, the pull-in time is programmed to be relatively constant until about 15 volts at which state the pull in time increases with decreasing voltage.

Figure 4:
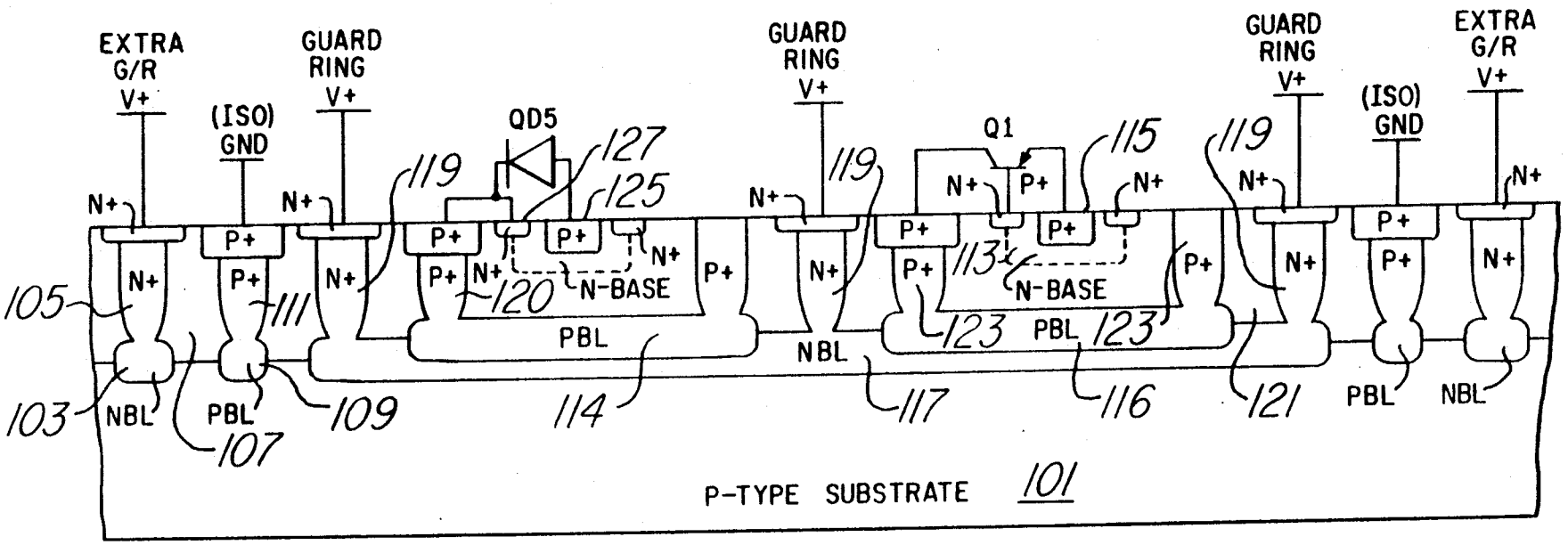
FIG. 4 is a cross section of a semiconductor device embodying some of the circuitry set forth in FIG. 2.

Referring now to FIG. 4, there is shown a cross section of a semiconductor device embodying some of the circuitry set forth in FIG. 2. The device is built on a p-type substrate 101 which is connected to ground. Transistor Q1 is fabricated in a completely isolated epitaxial tank which is completely enclosed and surrounded by an n-type buried layer (NBL) 117 on the surface of substrate 101 and a deep n+ connection region 119 to layer 117, forming an isolation ring also referred to herein as a guard ring. The region 119 is tied to V+ to prevent parasitic conditions or current flow during operation below ground potential. In addition, the region 121 on the surface of substrate 101 and within the isolation ring 119 is n-type material. A p-type buried layer (PBL) 116 is formed on the surface of the substrate 101 and within the isolation ring 119 and has a deep p+ connection region 123 thereto which is the collector contact for transistor Q1. The base of transistor Q1 is formed by providing an n- diffusion 113 with a p+ region 115 being the emitter. This provides a completely isolated pnp structure which can go below ground and operate above ground as long as it does not go above Vcc.

Diode QD5 (FIGS. 2 and 4) prevents the structures of transistors Q1, Q2, Q3 and Q4 (FIG. 2) from becoming biased on in the reverse direction in the inverted mode when the output has gone positive during the normal charge current mode. In the normal charge current mode with the output positive and without diode QD5 in the circuit, a voltage would be placed on the collector of transistor Q1 which would be positive and there would potentially be a more negative voltage on the base of transistor Q1. The emitter of transistor Q1 is connected essentially to ground. Therefore with a positive voltage on the collector of transistor Q1 and the base thereof at a lower voltage, transistor Q1 would turn on and operate in the inverted mode, causing current to be shunted away from the load. This is prevented by blocking diode QD5 which can also go negative below ground. Diode QD5 is fabricated by using an isolated p-type barrier layer (PBL) 114 having a p+ sidewall connecting region 120 embedded in an n-type barrier layer 117 which has an n+ sidewall region 119 which is tied to the positive supply V+ to operate as an isolation ring. The anode of diode QD5 is tied to the collector of transistor Q1 and the cathode of diode QD5 is tied to the output. Therefore, when the output goes positive, diode QD5 provides blocking. However, below ground voltage it is necessary to prevent diode QD5 from being forward biased to the substrate which would occur if a normal epitaxial base were used. Accordingly, the anode is tied to a p+ diffusion 125 and the cathode is tied to n+ region 127 which is the normal base diffusion of the transistor Q1. In this case both the collector and the base are tied together to provide a short circuited collector-base to provide a n-connection. The tie off is to prevent, when the output goes negative, lateral or vertical npn action where the guard ring is acting as a collector and the p+ region is acting as a base and the n+ region is acting as an emitter. This prevents forward biasing of the p+-n+ region. For additional protection, there is provided a further PBL 109 external to the NBL region 117 and on the surface of the substrate 101 which is coupled to ground via a p+ connection 111. Also, an extra isolation ring is provided by the further NBL 103 external to the PBL region 109 and in the surface of the substrate 101 which is connected to a positive voltage source via an n+ connection 105. The connection regions 105, 111, 119 and 120 are separated from each other by a an n-type region such as shown as 107.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

We claim:

1. A driver circuit for a coil which comprises:

(a) a coil coupled between a terminal at reference potential and an output terminal;

(b) a voltage source;

(c) a voltage source connecting circuit responsive to a predetermined condition to connect said voltage source across said coil;

(d) first parameter sensing means responsive to a first current value from said voltage source to said coil to cause said voltage source connecting circuit to disconnect said voltage source from said coil and cause a voltage reversal across said coil;

(e) a shunt current path connected across the coil for limiting voltage across the coil during disconnection;

(f) second parameter means causing said connecting circuit to reconnect said voltage source when a recirculating current through said shunt current path reaches a second current level; and (g) timing means coupled to said first and second parameter sensing means to reduce the level of each of said first current value and said second current value.

2. The circuit of claim 1 wherein said first parameter sensing means is a current sensing means.

3. The circuit of claim 1 wherein said second parameter sensing means is a current sensing means.

4. The circuit of claim 2 wherein said second parameter sensing means is a current sensing means.

5. The circuit of claim 1 wherein said shunt current path comprises a plurality of semiconductor devices disposed in a semiconductor substrate, said substrate including a first isolation ring in said substrate isolating said circuit means within said substrate.

6. The circuit of claim 5 further including a second isolation ring at said reference potential surrounding said first isolation ring and a third isolation ring surrounding said second isolation ring.

7. The circuit of claim 2 wherein said shunt current path comprises a plurality of semiconductor devices disposed in a semiconductor substrate, said substrate including a first isolation ring in said substrate isolating said circuit means within said substrate.

8. The circuit of claim 7 further including a second isolation ring at said reference potential surrounding said first isolation ring and a third isolation ring surrounding said second isolation ring.

9. The circuit of claim 3 wherein said shunt current path comprises a plurality of semiconductor devices disposed in a semiconductor substrate, said substrate including a first isolation ring in said substrate isolating said circuit means within said substrate.

10. The circuit of claim 9 further including a second isolation ring at said reference potential surrounding said first isolation ring and a third isolation ring surrounding said second isolation ring.

11. The circuit of claim 4 wherein said shunt current path comprises a plurality of semiconductor devices disposed in a semiconductor substrate, said substrate including a first isolation ring in said substrate isolating said circuit means within said substrate.

12. The circuit of claim 11 further including a second isolation ring at said reference potential surrounding said first isolation ring and a third isolation ring surrounding said second isolation ring.

13. A method of driving a coil which comprises the steps of:

(a) providing a coil coupled between a terminal at reference potential and an output terminal;

(b) providing a voltage source;

(c) connecting said voltage source across said coil responsive to a predetermined condition;

(d) disconnecting said voltage source from said coil and causing a voltage reversal across said coil responsive to a first current value from said voltage source to said coil;

(e) providing a current path across said coil to limit voltage across said coil;

(f) reconnecting said voltage source across said coil responsive to a second current value through said current path during disconnection; and (g) reducing the level of each of said first current value and said second current value after a predetermined time.

14. The circuit of claim 13 wherein said first parameter is current.

15. The circuit of claim 13 wherein said second parameter is current.

16. The circuit of claim 14 wherein said second parameter is current.

* * * * *